US006800104B2

(12) United States Patent
Rosenbaum

(10) Patent No.: US 6,800,104 B2
(45) **Date of Patent: *Oct. 5, 2004**

(54) FUEL GAS FOR TOOLS OPERATED BY INTERNAL COMBUSTION

(75) Inventor: Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 09/903,896

(22) Filed: Jul. 12, 2001

(65) Prior Publication Data

US 2002/0005010 A1 Jan. 17, 2002

(30) Foreign Application Priority Data

Jul. 13, 2000 (DE) ..... 100 34 016

(51) Int. Cl.[7] ..... C10L 1/18; C10L 1/12
(52) U.S. Cl. ..... 44/448; 44/458; 44/628
(58) Field of Search ..... 44/448, 458, 628

(56) References Cited

U.S. PATENT DOCUMENTS

| | | | | | |
|---|---|---|---|---|---|
| 2,032,431 | A | | 3/1936 | Odell | |
| 3,660,059 | A | | 5/1972 | Hollemann et al. | |
| 3,894,848 | A | * | 7/1975 | Kleinman | 44/628 |
| 4,844,713 | A | * | 7/1989 | Yu | 44/300 |
| 5,380,346 | A | * | 1/1995 | Fritz | 44/401 |
| 5,607,486 | A | * | 3/1997 | Wilkins, Jr. | 44/307 |
| 5,632,786 | A | * | 5/1997 | Basu et al. | 44/448 |
| 6,607,567 | B1 | * | 8/2003 | Towfighi | 44/448 |

FOREIGN PATENT DOCUMENTS

| | | | |
|---|---|---|---|
| CN | 1056517 | | 11/1991 |
| CN | 1206039 | * | 1/1999 |
| CN | 1250078 | * | 4/2000 |
| CN | 1260382 | * | 7/2000 |
| DE | 0172342 | | 7/1905 |
| EP | 1093889 | | 4/2001 |
| FR | 0754366 | | 11/1933 |
| FR | 1299549 | | 6/1962 |
| JP | 57133191 | * | 8/1982 |
| JP | 01311191 | * | 12/1989 |

* cited by examiner

*Primary Examiner*—Cephia D. Toomer
(74) *Attorney, Agent, or Firm*—Sidley Austin Brown & Wood, LLP

(57) ABSTRACT

A fuel gas is described for tools, operated by internal combustion, especially for setting devices for fostering elements, based on combustible gases containing a fragrance or a mixture all fragrances.

6 Claims, No Drawings

FUEL GAS FOR TOOLS OPERATED BY INTERNAL COMBUSTION

FIELD OF INVENTION

The object of the present invention is a fuel gas for tools operated by internal combustion, especially for setting devices for fastening elements, based on combustible gases.

BACKGROUND INFORMATION AND PRIOR ART

Tools, which are operated by internal combustion and are of the type under consideration here, namely setting devices for fastening elements, are known from the DE-A-4 032 202. With the help of these tools, fastening elements, such as nails, bolts, etc. can be driven directly under the action of internal combustion, normally a powder charge or a combustible mixture of gases, into materials, such as wood, steel, concrete etc., to which the corresponding component is to be fastened.

Such internal combustion-operated tools comprise, for example, a combustion chamber and a piston, which can be moved in a piston guide and is acted upon and by the expanding combustion gases generated in the combustion chamber. By igniting a mixture of air and fuel present in the combustion chamber, or by firing a propellant powder charge, the piston is moved away from the combustion chamber, strikes the fastening element and drives it into the substrate material. In this connection, the energy, obtained by burning the fuel gas, depends very much on the combustion rate, which in turn depends on the ratio of air to gas.

Tools of this type, which are operated by internal combustion, are known, for example, from the DE-A-40 32 20 and the U.S. Pat. No. 5,842,623.

The tool, described in U.S. Pat. No. 5,842,623, is operated by internal combustion using a mixture of methylacetylene and propadiene or a mixture of propane, butane, propylene or ethane as fuel gas. For the tools of the type in question here, which are commercially obtainable and operated by internal combustion, especially mixtures of methylacetylene, propadiene, propylene and a butane are used, which are also known under the name of MAPP. This gas is a waste product, which is formed when coking bituminous coal and offers a relatively high combustion rate, which is important for a high effectiveness of the tools.

In the older, unpublished DE-A-199 50 348.6 of the Applicant, a fuel gas for tools, which are operated by internal combustion, especially for setting devices for fastening elements, on the basis of combustible gases, is already described. This fuel gas comprises a mixture, which contains (A) 40 to 70 percent by weight of dimethyl ether, dinitrogen monoxide and/or nitromethane, (B) 8 to 20 percent by weight of propylene, methylacetylene, propane and/or propadiene and (C) to 20 to 45 percent by weight of isobutane and/or n-butane. This mixture is not poisonous, can be procured simply and inexpensively, makes available the necessary combustion energy, enables this combustion energy to be adjusted selectively, can be used even at low temperatures and makes possible compliance with the aerosol regulations.

However, it has turned out that this fuel gas, depending on its components, has either no odor or an unpleasant odor. In the first case, it is impossible to identify reliably any fuel gas escaping and, in the second case, the user finds it unpleasant to use the fuel gas, especially in closed rooms.

OBJECT OF THE INVENTION

Accordingly, it is an object of the present invention to indicate a fuel gas for tools, which are operated by internal combustion, especially for setting devices for fastening elements, which can be identified reliably not only in the event of leaks but also as an indication of the manufacturer, and which does not represent an annoyance to the user.

SUMMARY OF THE INVENTION

Pursuant to the invention, this objective is accomplished by a fuel gas based on combustible gases, which contains a fragrance or a mixture all fragrances.

The object of the invention therefore is the fuel gas of claim 1. The dependent claims relate to preferred embodiments of this object of the invention.

Preferably, the fuel gas contains the fragrance or the mixture of fragrances in an amount, which masks the inherent odor of the combustible gases, preferably in an amount of 0.0001 to 5 percent by weight and particularly of 0.01 to 1 percent by weight.

Advantageously, the fragrance or the mixture of fragrances is present in liquid form or as a solution in the combustible gases. In the event that the fragrance or the mixture of fragrances is not soluble in the combustible gases, a solvent, which burns without leaving any residue, such as a liquefied fuel gas and/or a low molecular weight ether, such as dimethyl ether, may be used if necessary.

In accordance with a preferred embodiment, the inventive fuel gas contains a fragrance or a mixture of fragrances with a greenery character, a citrus character, a lavender character, a flowery character, an aldehyde character, a Cyprus character, a fern character, a spice character, an oriental character, a wood character, a tobacco character and/or a leather character. Such fragrances or mixtures of fragrances are known to those skilled in the art and are commercially obtainable, for example, from Dragoco GmbH, Holzminden (DE) or L. Givaudan & Cie (CH). They can be selected advantageously from the group comprising amyl salicylate, anisaldehyde, benzyl salicylate, butyl cinnamaldehyde, citronellol, cyclohexyl salicylate, eugenol, exaltex, tricyclodecenyl acetate, geraniol, herb avert, β-ionone, gamma methyl ionone, keone, methylcedrylone, methyl cyclogeraniate, rose oxide DL, patchouli, phenyl ethyl alcohol, terpineol, tonalid, undecavertol, Vanillin, Ylang Oliffac 765, Ambreton, Linacsol, methanyl acetate T, methyl sandeflor, trepanol, dihydroterpineol T. Grisalva, Mayol, Ambrox Coeur, Parmantheme, coumarin, LRG 201, paramethoxyacetophenone, musk ketone, Galaoxide 50, tricyclodecenyl propionate, Traseolide 70, Sinocitryl, dimethyloctanol, musk xylene, Cashmeran, Clonal, Camekol DH, Sandalore, Rhubafuran V-9042, Ceromel 3, Marenil (N), Corps. rhubarb, clove oil, phenyl ethyl acetate, Toka lactone, Exaltolide, Isojasmon, Ambrettolid, Dihydrofloralol, Cedar English, Nardorsol, fenchyl alcohol, β-naphthyl methyl ether and tridecene-2-nitrile.

In view of the application in a fuel gas, the use of fragrances or mixtures of fragrances, which burn without leaving a residue if the fuel gas is used as specified, is particularly preferred. Examples of these are the following, highly volatile, low boiling fragrances: anethol, benzaldehyde, benzyl acetate, benzyl alcohol, benzyl formate, isobomyl acetate, camphor, cis-citral (neral), citronellal, citronellol, citronellyl acetate, pcymene, decanal, dihydrorolinalool, dihydromyrcenol, dimethylphenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, α-methylionone, methylnonyl acetaldehyde, methylphenylcarbinyl acetate, levomethyl acetate, menthone, isomenthone, myrcene, myrcenyl acetate, myrcenol, neryl acetate, nonyl acetate, phenyl ethyl alcohol, α-pinene, β-pinene, γ-pinene, α-terpineol, β-terpineol, terpinyl acetate and Vertenex (p-t-butylcyclohexyl acetate) and mixtures thereof.

Fragrances and mixtures of fragrances based on natural oils, which contain high percentages of largely volatile fragrances, for example, those with a flowery character, such as a rose character, a violet character, a lilac character or Lavendel, Lavandin, citrus oils, such as those of the citron, lemon and orange, for example, limoneneand orange terpenes, clove oil and also vanilla fragrances are particularly preferred pursuant to the invention.

The combustible gases of the inventive fuel gas may be the gases or gas mixtures, which are conventionally used as fuel gas for tools operated by internal combustion, especially for setting devices for fastening elements. However, particularly preferred are combustible gases based on a mixture containing (A) 40 to 70 percent by weight of dimethyl ether, dinitrogen monoxide and/or nitromethane, (B) 8 to 20 percent by weight of propylene, methylacetylene, propane and/or propadiene and (C) 20 to 45 percent by weight of isobutane and/or n-butane, the sum of the components amounting to 100 percent by weight. In this connection, the components (A), (B) and (C) may each contain one or more representatives of the combustible gases given.

Component (A) preferably is present in an amount of 50 to 60 percent by weight, component (B) preferably is present in an amount of 10 to 15 percent by weight and component (C) preferably is present in an amount of 25 to 35 percent by weight of the mixture.

Preferably, this fuel gas contains dimethyl ether as component (A), propane as component (B) and isobutane as component (C). In accordance with a particularly preferred embodiment, the inventive fuel gas comprises a mixture of 58 percent by weight of dimethyl ether, 10 percent by weight of propylene and 32 percent by weight of isobutane.

In addition, small amounts of other combustible gases, which are not poisonous and do not have a negative effect on the vapor pressure and the combustion rate of the mixture, may be contained in the inventive fuel gas.

The inventive fuel gas may additionally contain a lubricant, for example one based on a mineral oil or a silicone oil, for lubricating the valve devices, which are required for introducing the fuel gas into the combustion chamber, or the piston or similar moving parts in the equipment (compare a 2-stroke internal combustion engine).

Because a fragrance or a mixture of fragrances is contained pursuant to the invention, it is readily possible to identify fuel gas emerging from the pressure vessel and, with that, to prevent any possible danger. Furthermore, the presence of the fragrance or mixture of fragrances enables the fuel gas to be characterized with respect to its special area of use and also as an indication of the manufacturer. Since the fragrances, used pursuant to the invention, need be employed only in samll amounts for the intended purpose, they are carried along readily by the combustible gases of the fuel gas and do not lead to any impairment of the function of the tool driven by internal combustion. Furthermore, because of the slightest traces of remaining fragrances in the exhaust gas, a pleasant, aromatized working atmosphere is brought about for the user of the tool.

The following example explains that the invention further.

EXAMPLE

A combustible gas is formed from 58 percent by weight of dimethyl ether as component (A), 10 percent by weight of propylene as component (B) and 32 percent by weight of isobutane as component (C). A mixture of equal parts of eugenol, isoeugenol and clove oil is added to this combustible gas in an amount of 0.5% and a fuel gas is obtained with a pleasant clove aroma, which has a sufficiently high vaporization pressure at 50° C. for use as a fuel gas for setting devices for fastening elements.

Because of the clove fragrance, any fuel gas, emerging from the pressure vessel, can readily be detected by the odor. Moreover, the use of the fuel gas imparts a pleasant clove odor, which enables the user to differentiate this fuel gas from other fuel gases.

What is claimed is:

1. A fuel gas for tools operated by internal combustion, comprising a mixture containing (A) 40% to 70% by weight of dimethyl ether, dinitrogen monoxide and/or nitromethane, (B) 8% to 20% by weight of propylene, methylacetylene, propane and/or propadiene, and (C) 20% to 45% by weight of isobutane and/or n-butane; and contains a fragrance or mixture of fragrances with a greenery character, a citrus character, a lavender character, a flowery character, an aldehyde character, a cypress character, a Fougére character, a spice character, an oriental character, a wood character, a tobacco character and/or a leather character, which burns without leaving a residue when fuel gas is used in the intended manner, in an amount sufficient to substantially mask the inherent odor of the combustible gases.

2. The fuel gas of claim 1, characterized in that the fragrance or the mixture of fragrances is contained in an amount of 0.0001% to 5% by weight.

3. The fuel gas of claim 1, wherein the fragrance or the mixture of fragrances is contained in the combustible gases in liquid form or as a solution.

4. The fuel gas according to claim 1, wherein the fuel gas comprises a mixture of 50% to 60% by weight of component (A), 10% to 15% by weight of component (B) and 25% to 35% by weight of component (C) as combustible gases.

5. The fuel gas of claim 4, wherein dimethyl ether is contained as component (A), propylene is contained as component (B), and isobutane is contained as component (C).

6. The fuel gas of claim 4, wherein the fuel gas comprises a mixture of 58% by weight of dimethyl ether, 10% by weight of propylene and 32% by weight of isobutane as combustible gases.

* * * * *